US011241034B2

(12) United States Patent
Xu et al.

(10) Patent No.: US 11,241,034 B2
(45) Date of Patent: Feb. 8, 2022

(54) MICRO-VAPORIZER WITH MULTIPLE LIQUIDS

(71) Applicant: Blackship Technologies Development LLC, North Chesterfield, VA (US)

(72) Inventors: Yongjie Xu, Richmond, VA (US); Donovan Phillips, Richmond, VA (US)

(73) Assignee: Blackship Technologies Development LLC, North Chesterfield, VA (US)

( * ) Notice: Subject to any disclaimer, the term of this patent is extended or adjusted under 35 U.S.C. 154(b) by 410 days.

(21) Appl. No.: 16/200,880

(22) Filed: Nov. 27, 2018

(65) Prior Publication Data

US 2019/0166911 A1 Jun. 6, 2019

Related U.S. Application Data

(60) Provisional application No. 62/594,187, filed on Dec. 4, 2017.

(51) Int. Cl.
*A24F 40/30* (2020.01)
*A24F 40/42* (2020.01)
(Continued)

(52) U.S. Cl.
CPC ..... *A24D 1/002* (2013.01); *A24F 40/30* (2020.01); *A24F 40/42* (2020.01); *A24F 40/44* (2020.01);
(Continued)

(58) Field of Classification Search
CPC ..... A24F 40/10; A24F 40/30; A24F 40/40; A24F 40/42; A24F 40/485
See application file for complete search history.

(56) References Cited

U.S. PATENT DOCUMENTS

2014/0261488 A1* 9/2014 Tucker ..... A61M 11/042 131/328
2014/0366898 A1* 12/2014 Monsees ..... A24F 40/30 131/329
(Continued)

FOREIGN PATENT DOCUMENTS

CN 101116542 2/2008
CN 103960780 8/2014
(Continued)

OTHER PUBLICATIONS

U.S. Appl. No. 15/639,139, filed Jun. 2017, Xu et al.
(Continued)

*Primary Examiner* — Erin E McGrath
(74) *Attorney, Agent, or Firm* — Hunton Andrews Kurth LLP

(57) ABSTRACT

A micro-vaporizer has an annular main body, a vaporization chamber, and a liquid delivery arrangement. The liquid delivery arrangement is configured for sequential delivery of a plurality of vaporizable liquids to the vaporization chamber. The liquid delivery arrangement has an annular wick having an internal wick surface defining at least a portion of the vaporization chamber. The liquid delivery arrangement also comprises a liquid reservoir surrounding the wick. The liquid reservoir is configured for storage of at least one vaporizable liquid therein and is in fluid communication with the wick. A heating element is positioned within the vaporization chamber for heating and vaporizing vaporizable liquid at or near the internal wick surface.

7 Claims, 11 Drawing Sheets

(51) Int. Cl.

| | |
|---|---|
| ***A24F 40/44*** | (2020.01) |
| ***A24F 40/485*** | (2020.01) |
| ***A24F 40/10*** | (2020.01) |
| ***A24D 1/00*** | (2020.01) |
| ***F22B 1/28*** | (2006.01) |

(52) U.S. Cl.
CPC ..... *A24F 40/485* (2020.01); *F22B 1/284* (2013.01); *A24F 40/10* (2020.01)

(56) References Cited

U.S. PATENT DOCUMENTS

| | | | | |
|---|---|---|---|---|
| 2015/0351456 | A1* | 12/2015 | Johnson | A24F 40/30 131/329 |
| 2016/0324216 | A1* | 11/2016 | Li | A24F 40/42 |
| 2018/0029782 | A1* | 2/2018 | Zuber | H05B 1/0227 |

FOREIGN PATENT DOCUMENTS

| | | |
|---|---|---|
| CN | 203789157 | 8/2014 |
| CN | 206603241 | 11/2017 |
| EP | 3031339 | 6/2016 |
| WO | 2016090426 | 6/2016 |
| WO | WO 2016/090426 | 6/2016 |
| WO | 2017064051 | 4/2017 |
| WO | WO 2017/064051 | 4/2017 |
| WO | WO 2017/121296 | 7/2017 |

OTHER PUBLICATIONS

National Intellectual Property Administration, PRC, Notification of Office Action and Search Report (with English Translation), Chinese Patent Application No. 2018114048663, dated Dec. 28, 2020, pp. 1-16.

Communication with Extended European Search Report, European Patent Office, European Patent Application No. 18209702.2, dated May 14, 2019, pp. 1-8.

* cited by examiner

MICRO-VAPORIZER WITH MULTIPLE LIQUIDS

This application claims priority to U.S. Provisional Application 62/594,187 filed Dec. 4, 2017, the complete disclosure of which is incorporated herein by reference.

BACKGROUND OF THE INVENTION

The invention relates generally to micro-vaporizers and, more particularly, to micro-vaporizers configured to use multiple vaporizable fluids.

Micro-vaporizers are devices in which a vaporizable fluid is drawn from a storage reservoir into a chamber where it is heated to vaporization temperature by a heating element. The vaporized fluid is then drawn or forced from the chamber. In products such as electronic cigarettes (also known as e-cigarettes or personal vaporizers), the vaporized fluid is drawn from the chamber through a mouthpiece and inhaled by the user. In other products the vaporized fluid is dispersed into the atmosphere.

The usual purpose of a device that uses a micro-vaporizer is to dispense one or more active substances using the vaporized fluid. In atmospheric dispensers, these substances may include materials such as deodorizing agents, fragrance, and insect repellant. In the case of personal vaporizers, the active substances typically include a flavorant (i.e., a flavoring agent or material) and nicotine. The flavorant and nicotine levels may be selected so as to mimic the experience of smoking a cigarette.

SUMMARY OF THE INVENTION

An aspect of the invention provides a micro-vaporizer comprising an annular main body defining a main body interior, a vaporization chamber within the main body interior, and a liquid delivery arrangement. The liquid delivery arrangement is configured for sequential delivery of a plurality of vaporizable liquids to the vaporization chamber. The liquid delivery arrangement comprises an annular wick having an internal wick surface defining at least a portion of the vaporization chamber. A wick casing having a circumferential casing wall surrounds the annular wick. The casing wall has a liquid flow opening formed therethrough. The liquid delivery arrangement also comprises a liquid reservoir surrounding the wick casing. The liquid reservoir is configured for storage of at least one vaporizable liquid therein and is in fluid communication with the wick via the liquid flow opening in the casing wall. The micro-vaporizer further comprises a heating element disposed within the vaporization chamber. The heating element has a heating surface adjacent or in contact with at least a portion of the internal wick surface for heating and vaporizing vaporizable liquid at or near the internal wick surface. An air flow passage from one or more air intake openings in the case wall to the vaporization chamber provides a path for air from an external ambient environment to flow into the vaporization chamber for mixing with vaporized liquid to form a vaporization mixture. A vaporization mixture flow passage extends from the vaporization chamber to an exit port. In particular applications, the plurality of vaporizable liquids includes a first vaporizable liquid comprising a first active material at a first concentration and a second vaporizable liquid comprising a second active material at a second concentration. In certain of these applications, the first active material is the same as the second active material but the first concentration is different from the second concentration.

BRIEF DESCRIPTION OF THE DRAWINGS

The invention can be more fully understood by reading the following detailed description together with the accompanying drawing, in which like reference indicators are used to designate like elements, and in which.

DETAILED DESCRIPTION OF THE INVENTION

Figure 1:
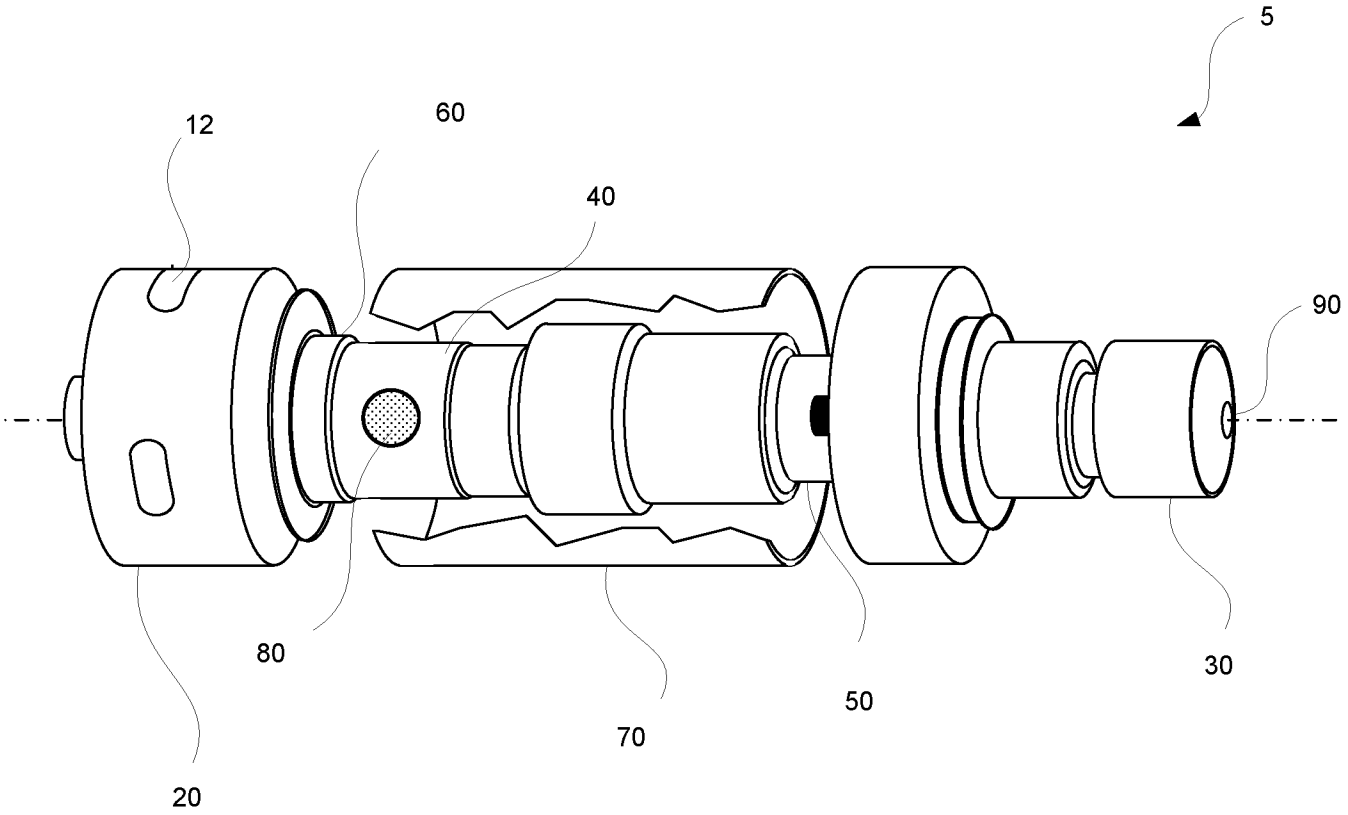
FIG. 1 is an exploded perspective view of a personal vaporizer according to an embodiment of the invention.
Figure 2:
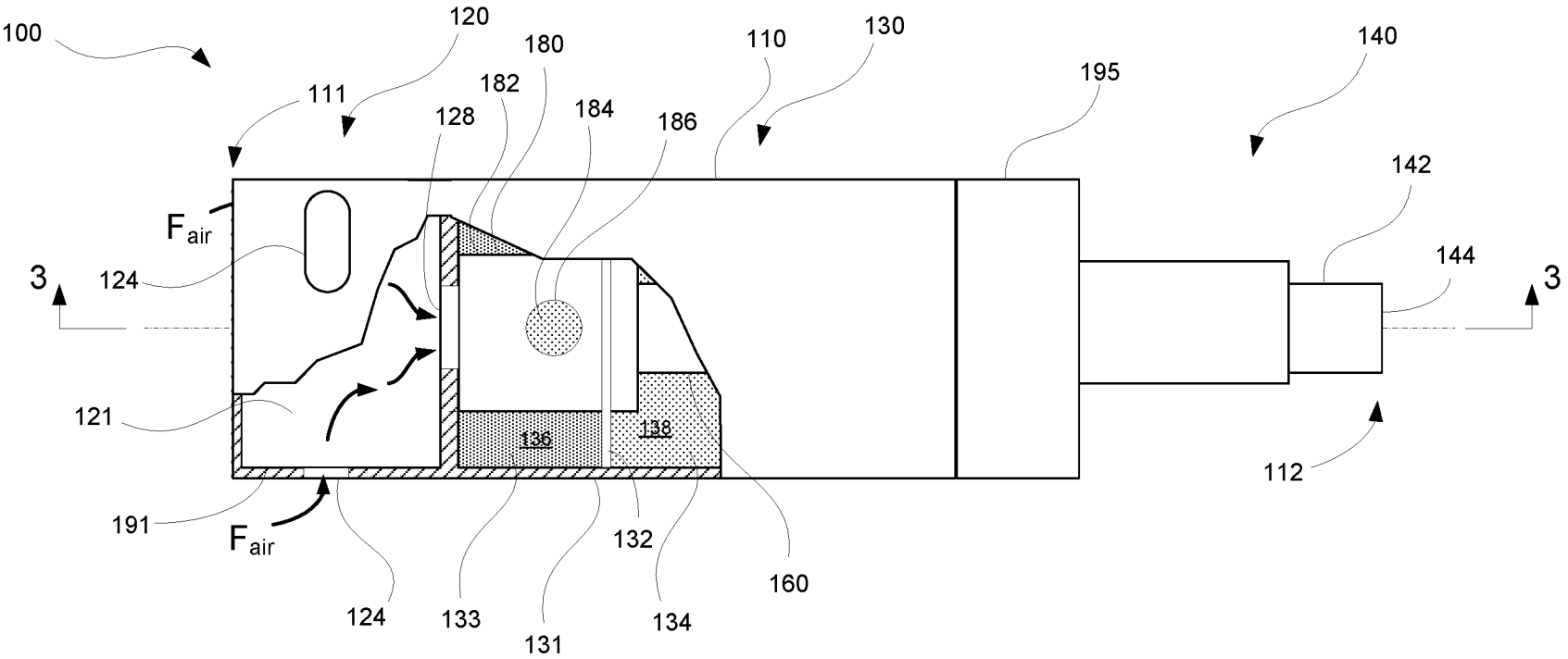
FIG. 2 is a partially sectioned view of a personal vaporizer according to an embodiment of the invention.

One aspect of prior art vaporizers is that they use a single vaporizable fluid with a single set of characteristics. With personal vaporizers, this means a single flavor profile and potency. In many cases, it may be desirable to vary the flavor profile or potency of the vaporizable liquid or to alter the level of another active material. One particular example is a user's first use of personal vaporizer with a particular flavorant. In such cases, it may be desirable to initiate the user with a lower strength flavorant level. Once the user has been initiated, the flavorant level may be stepped up to a higher strength level.

The present invention provides micro-vaporizers that use a plurality of vaporizable liquids. These micro-vaporizers may be configured so that at least two liquids having different characteristics are used in sequence. In some embodiments, the micro-vaporizer transitions from a first liquid to a second liquid automatically upon exhaustion of the first liquid. In other embodiments, the user may be required to initiate the use of the second liquid once the first is exhausted.

In each of various embodiments of the invention, a micro-vaporizer comprises one or more vaporizable fluid sources from which vaporizable fluid, typically comprising one or more active materials, is drawn to or is otherwise presented to a heat source that causes the fluid to be vaporized. The resulting vapor is mixed with air in a vaporization chamber, then passed to an exit chamber where it exits the device. In typical personal vaporizers, the exit chamber is defined by a mouthpiece (sometimes referred to as a "tip" or "drip tip") and the combined air/vapor mixture is drawn through and out of the device by inhalation of a user.

As used herein, the term "active material" refers to any material that controllably alters or adds to the vaporization products of the device. Depending on the application, active materials can include, without limitation, plant material, minerals, deodorizing agents, fragrances, insect repellants, medications, and disinfectants and any material or structure containing or incorporating any of the foregoing.

In the specific instance of personal vaporizers, active materials may include substances that augment the flavorant of the vaporizable fluid. These may include, without limitation, marijuana, hemp, cannabidiol (cbd), citronella, geraniol, mint, thyme, tobacco, *Salvia dorrii, Salvia, Passiflora incarnata, Arctostaphylos uva-ursi, Lobelia inflata*, lemon grass, cedar wood, clove, cinnamon, coumarin, helio, vanilla, menthol, *Eucalyptus*, peppermint, rosemary, lavender, licorice, and cocoa and any material or structure containing or incorporating any of the foregoing. The aforementioned active materials can be provided in varying concentrations or potency levels.

The invention will be described in more detail using examples and embodiments geared primarily to personal vaporizers. It will be understood, however, that the methods of the invention are not limited to such applications and can be applied to any micro-vaporizer device.

FIG. 1 illustrates a typical personal vaporizer 5 having an air inlet section 20 at its distal end and a mouthpiece section 30 at its proximal end. The vaporizer 5 also has a vaporization chamber 40 that is in fluid communication with the inlet section 20. The vaporization chamber 40 is fluidly connected to the mouthpiece section 30 by an air/vapor chimney 50. A heating coil head 60 is positioned upstream of the vaporization chamber 40 to power a heating coil disposed within the vaporization chamber 40. When a user inhales through the mouthpiece 30, air is drawn into the device 5 through a plurality of air inlets 12 and through an internal passage to the vaporization chamber 40. At the same time, the heating coil within the vaporization chamber 40 is activated. The heating coil heats the air in the chamber 40 along with vaporizable fluid drawn from a fluid reservoir 70 by a wicking material 80. The resulting combination of air and vapor is drawn through the chimney 50 to the mouthpiece 30 and out through the mouthpiece exit 90.

It will be understood that there are many other vaporizer configurations, but all have the general configuration of one or more air inlets upstream of a vaporization chamber and one or more exit ports downstream of the vaporization chamber. One or more passageways may connect the air inlets and the exit ports to the vaporization chamber.

The personal vaporizers of the prior art use a single vaporizable liquid drawn from or released by a single reservoir. The personal vaporizers of the present invention use mechanical/structural mechanisms and/or variations in fluid flow characteristics to allow the sequential use of multiple liquids in what are otherwise fairly standard personal vaporizer devices. The following paragraphs describe certain illustrative embodiments of the invention.

FIGS. 2, 3A, 3B, and 3C provide schematic depictions of a personal vaporizer 100 according to an illustrative aspect of the invention. The personal vaporizer 100 has a configuration similar to the vaporize shown in FIG. 1. It comprises a cylindrical body 110 having an air inlet section 120 defining a distal end 111, a reservoir/vaporization section 130, and a cap 195. A mouthpiece section 140 extends proximally from the cylindrical body 110. The mouthpiece section 140 comprises a mouthpiece 142 defining a proximal end 112 and an exit port 144.

The reservoir/vaporization section 130 includes a fluid reservoir 131 that is divided by a permeable barrier 132 into first and second reservoir chambers 133, 134. The first reservoir chamber 133 may be filled with a first vaporizable fluid 136 and the second reservoir chamber 134 may be filled with a second vaporizable fluid 138. The permeable barrier 132 may be configured and/or the flow characteristics of the vaporizable fluids 136, 138 tailored so that the first vaporizable fluid is inhibited or prevented from passing through the permeable barrier 132 into the second reservoir chamber 134 and so that the second vaporizable fluid 138 passes through the permeable barrier 132 only as the first vaporizable fluid 136 recedes away from contact with the barrier (i.e., is used up). In some cases, this may be accomplished, at least in part, by selecting the first vaporizable fluid 136 to have a higher viscosity than the second vaporizable fluid 138 and configuring the permeable barrier 132 to restrict the flow of liquids having a viscosity in excess of a threshold level that is in between that of the two fluids 136, 138.

The permeable barrier 132 may be formed from any suitable material that can be used to selectively allow the flow of some liquids but inhibit or prevent the flow of others, depending on particular characteristics of the liquids (e.g., viscosity). The materials, porosity and thicknesses of the permeable barrier 132 may be tailored to particular liquids. For example, for certain vaporizable liquids having a relatively high viscosity, the barrier 132 may be or include a simple metal screen or mesh. The openings in the screen may be sized so that one liquid's viscosity serves to inhibit its passage through the screen while allowing the passage of another. Other materials that could be used include woven and non-woven fiber structures that are formed to have the desired air flow-through and liquid flow inhibition characteristics. Such fiber structures could be made from natural or man-made polymeric fibers. Permeable polymeric membranes could also be used.

The fluid reservoir 130 may be configured as a simple tank divided into two chambers by the barrier 132. In some embodiments, however, one or both of the reservoir chambers 133, 134 may comprise an adsorptive or absorptive material or structure configured for retaining and/or transporting a liquid.

The reservoir/vaporization section further includes a fluid transport structure 180 that is configured and positioned to be in contact with fluid in the first reservoir chamber 133 and for drawing that fluid out of the first reservoir chamber 133. In the illustrated embodiment, the fluid transport structure 180 comprises a tubular wick structure 184 surrounded by a cylindrical case 182. An opening 186 in the case 182 allows fluid communication between the wick structure 184 and the fluid in the first reservoir chamber 133. The tubular wick structure 184 defines a vaporization chamber 187 in which a heating coil 150 is positioned. The wick structure 184 is configured to draw fluid from the first reservoir chamber 133 into close proximity or in contact with the heating element 150. The heating element 150 may be configured to heat the vaporizable fluid through any conductive, convective, and/or radiative heat transfer mechanism. In typical vaporizers, the heating element 150 is or includes a resistance element in the form of a wire coil. In some cases, the resistance element is housed within a heat conductive casing. A chimney 160 extends between the vaporization chamber 187 and the mouthpiece 142 and defines a passageway for air and vaporization products to flow from the vaporization chamber 187 to the exit port 144.

The air inlet section 120 has a case wall 191 defining an inlet chamber 121. One or more air inlet ports 124 are formed through the case wall 191 to allow air to pass from the atmosphere into the inlet chamber 121. An inlet passageway 128 provides fluid communication between the inlet chamber 121 and the vaporization chamber 187. Flow through the vaporizer 100 is illustrated by arrows. Upstream of the vaporization chamber 187, the flow is essentially air ($F_{air}$). Downstream of the vaporization chamber 187, the flow is essentially a combination of air and vaporization products.

While not shown in the drawings, the personal vaporizer 100 also includes a power source (e.g., a battery) in communication with the heating coil 150 and a mechanism for selectively activating the heating coil.

Figure 3A:
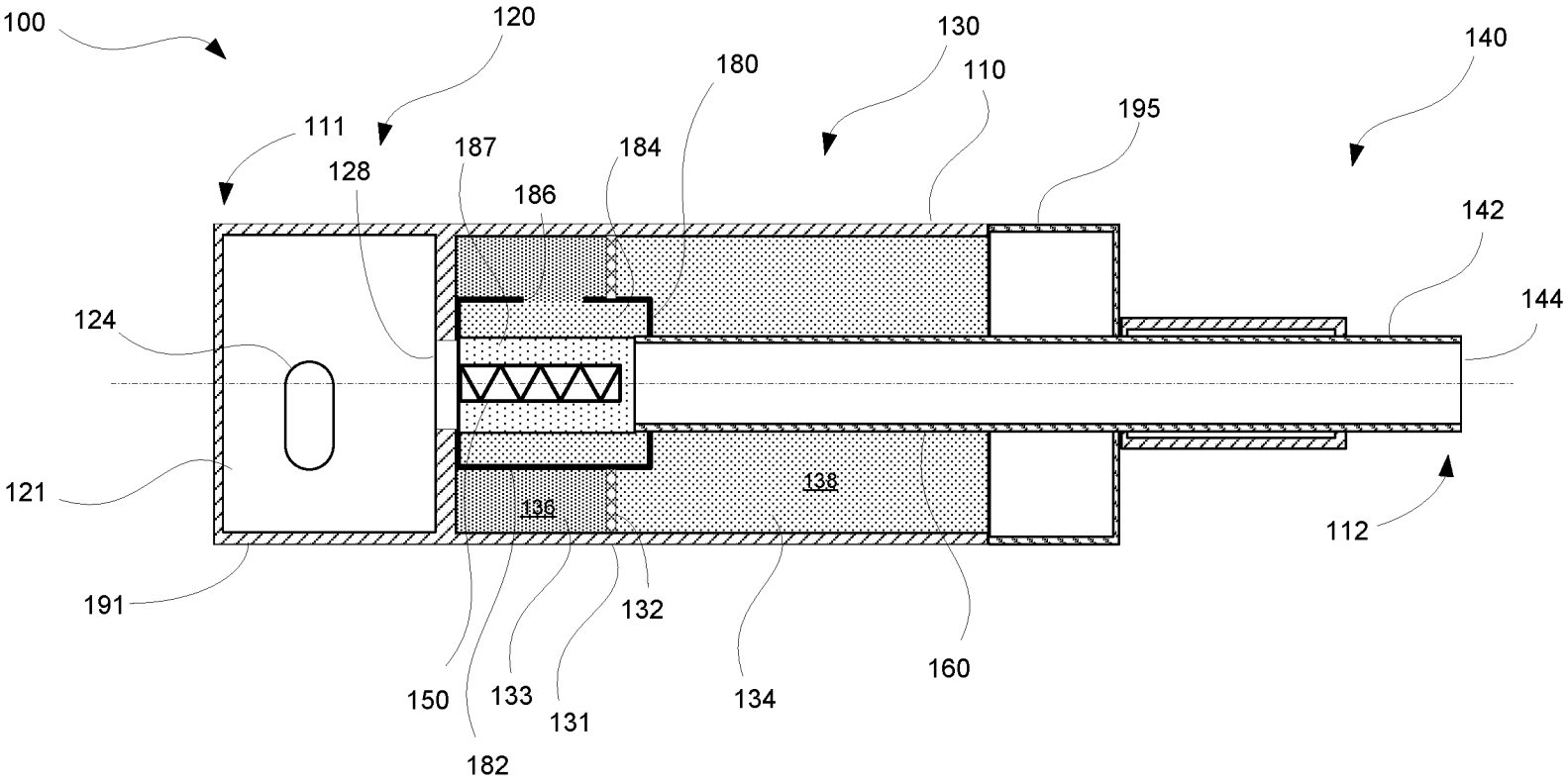
FIGS. 3A, 3B, and 3C are full sectioned views of the personal vaporizer of FIG. 2.
Figure 3B:
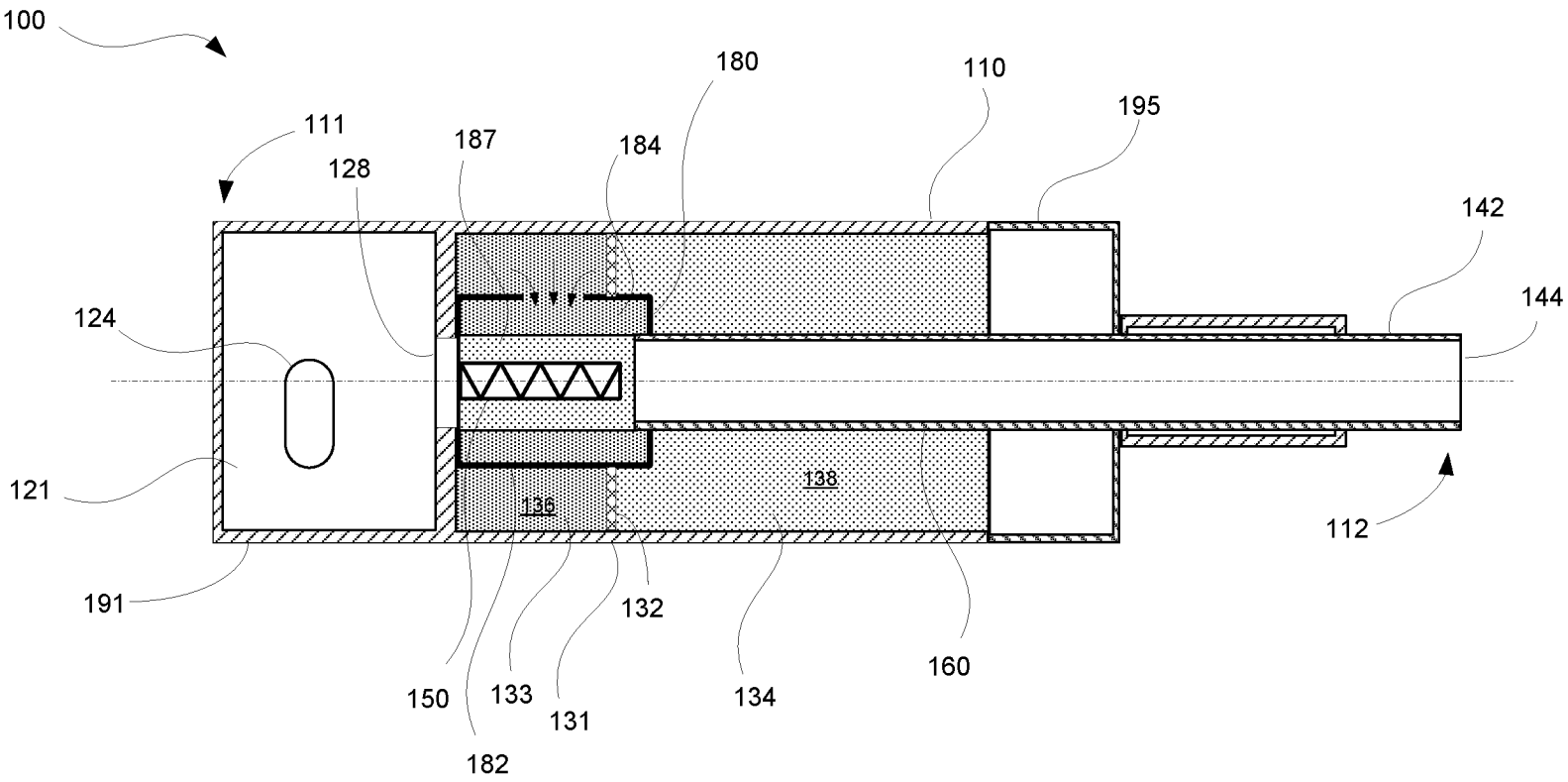
Figure 3C:
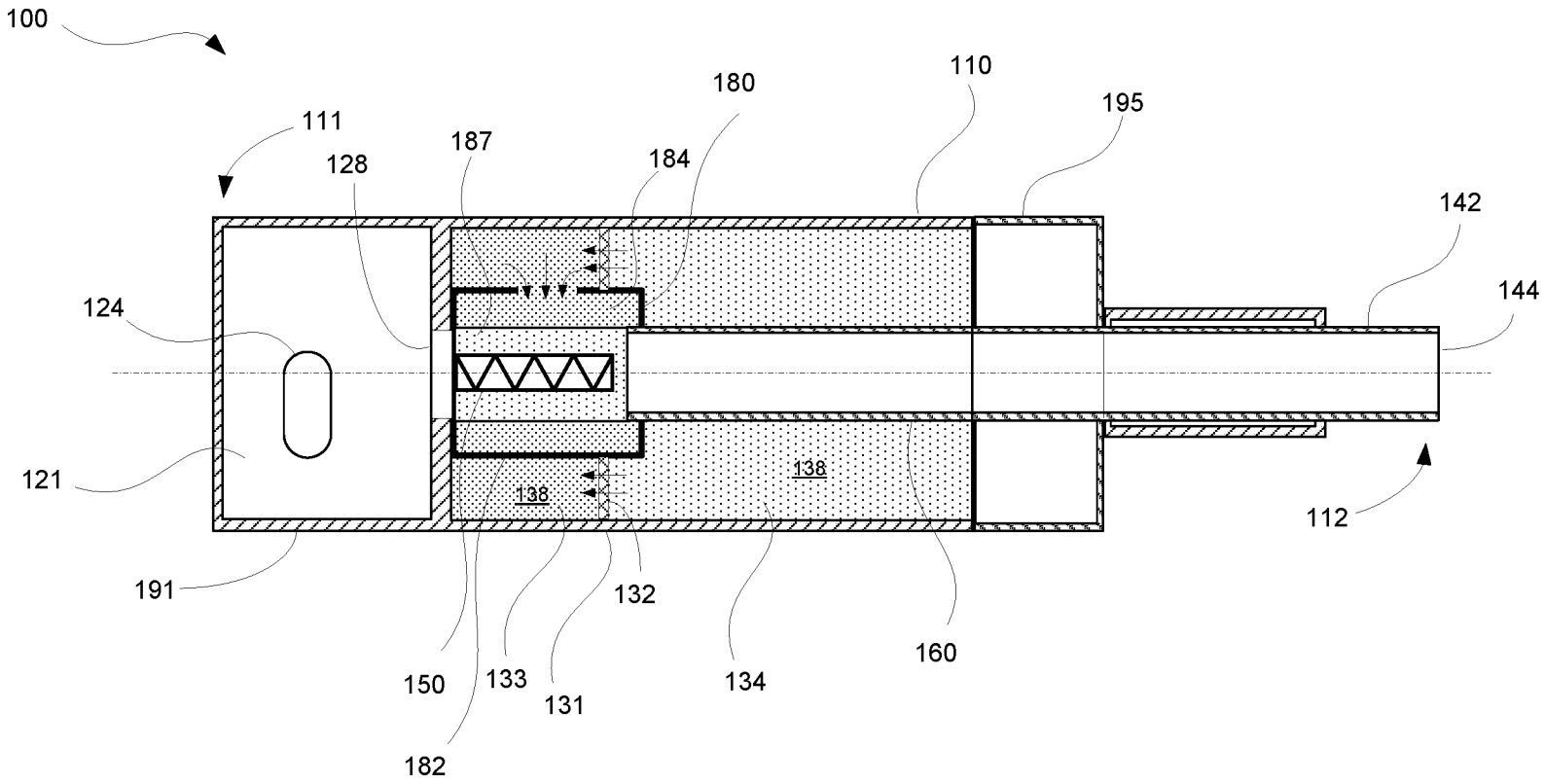

As noted above, the first reservoir chamber 133 may initially be filled with a first vaporizable fluid 136 and the second reservoir chamber 138 filled or partially filled with a second vaporizable fluid 138 as shown in FIG. 3A. When a personal vaporizer 100 has been loaded in this manner, initial use by a user will result in the first vaporizable fluid 136 being drawn into and through the wick material 184 and into the vaporization chamber 187 as shown in FIG. 3B. In this initial use, the vaporizer will produce a combined flow of air and vaporization products solely produced from the first vaporizable fluid 136. The user's initial experience will accordingly be based on the characteristics of the first vaporizable fluid 136 alone. As the first vaporizable fluid 136 is used, the second vaporizable fluid 138 will begin to flow through the permeable barrier 132 into the first reservoir chamber 133. Once the first vaporizable fluid 136 is exhausted, the flow from the first reservoir chamber 133 into the wicking material 184 will consist only of the second vaporizable fluid 138 as shown in FIG. 3C. At this point, the user's experience will be based solely on the characteristics of the second vaporizable fluid 138.

It will be understood that after initial use, but before exhaustion of the first vaporizable fluid 136, the flow of the second vaporizable fluid 138 into the first reservoir chamber 133 may result in some degree of mixing of the first and second vaporizable fluids 136, 138. This mixture can actually be used to provide the user with a transition from the characteristics of the first vaporizable fluid 136 to the characteristics of the second vaporizable fluid 138. This may be particularly desirable in cases where the first and second vaporizable fluids 136, 138 have substantially similar characteristics except for the relative strength of an active material disposed therein. For example, if the second vaporizable fluid 138 has a relatively intense flavor characteristic, the first vaporizable fluid 136 may be provided with a mild form of the same flavor characteristic. The intermediate mixture of the two flavor levels can reduce the user's "shock" at transitioning from the low to the high level.

Figure 4A:
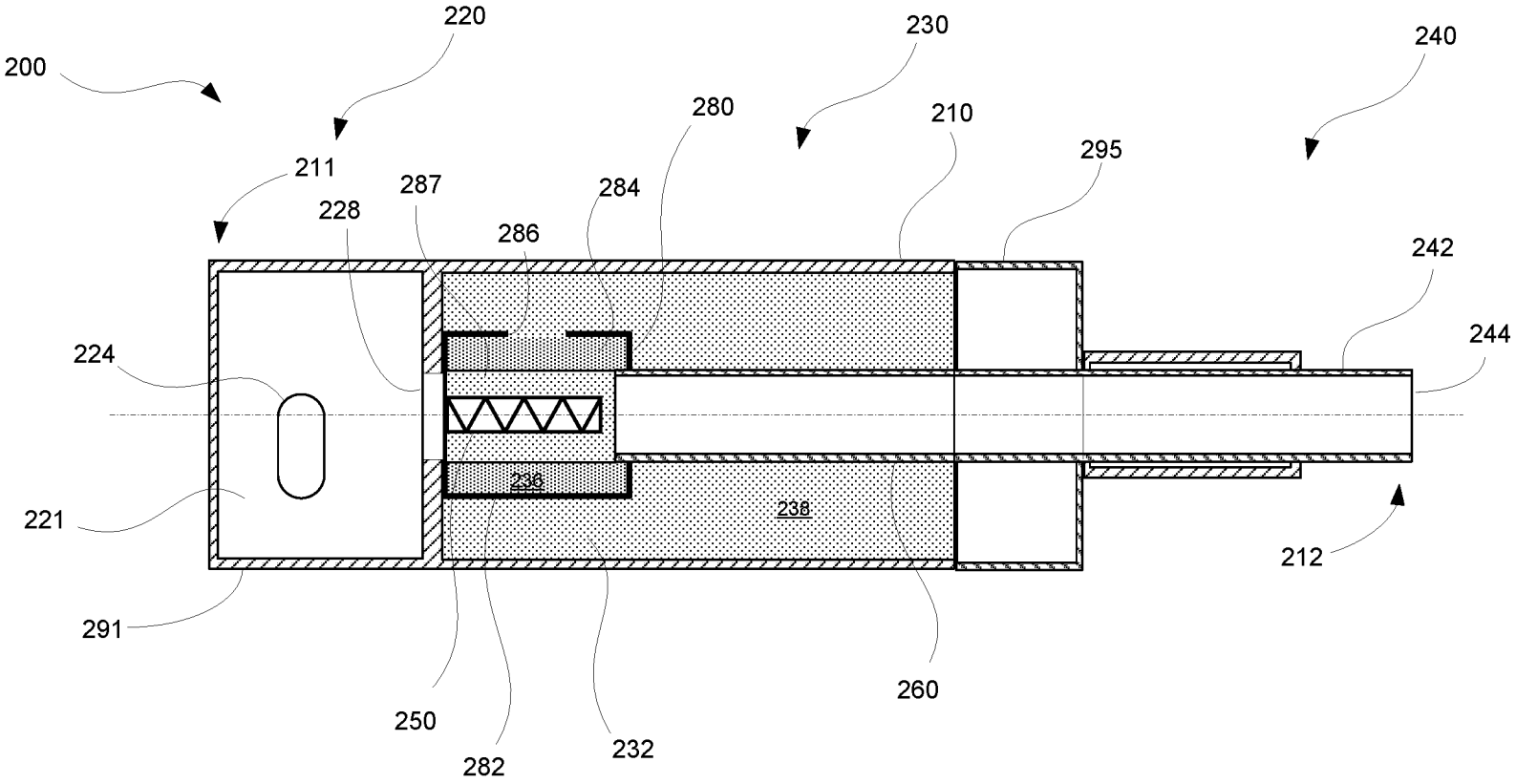
FIGS. 4A, 4B, and 4C are full sectioned views of a personal vaporizer according to an embodiment of the invention.
Figure 4B:
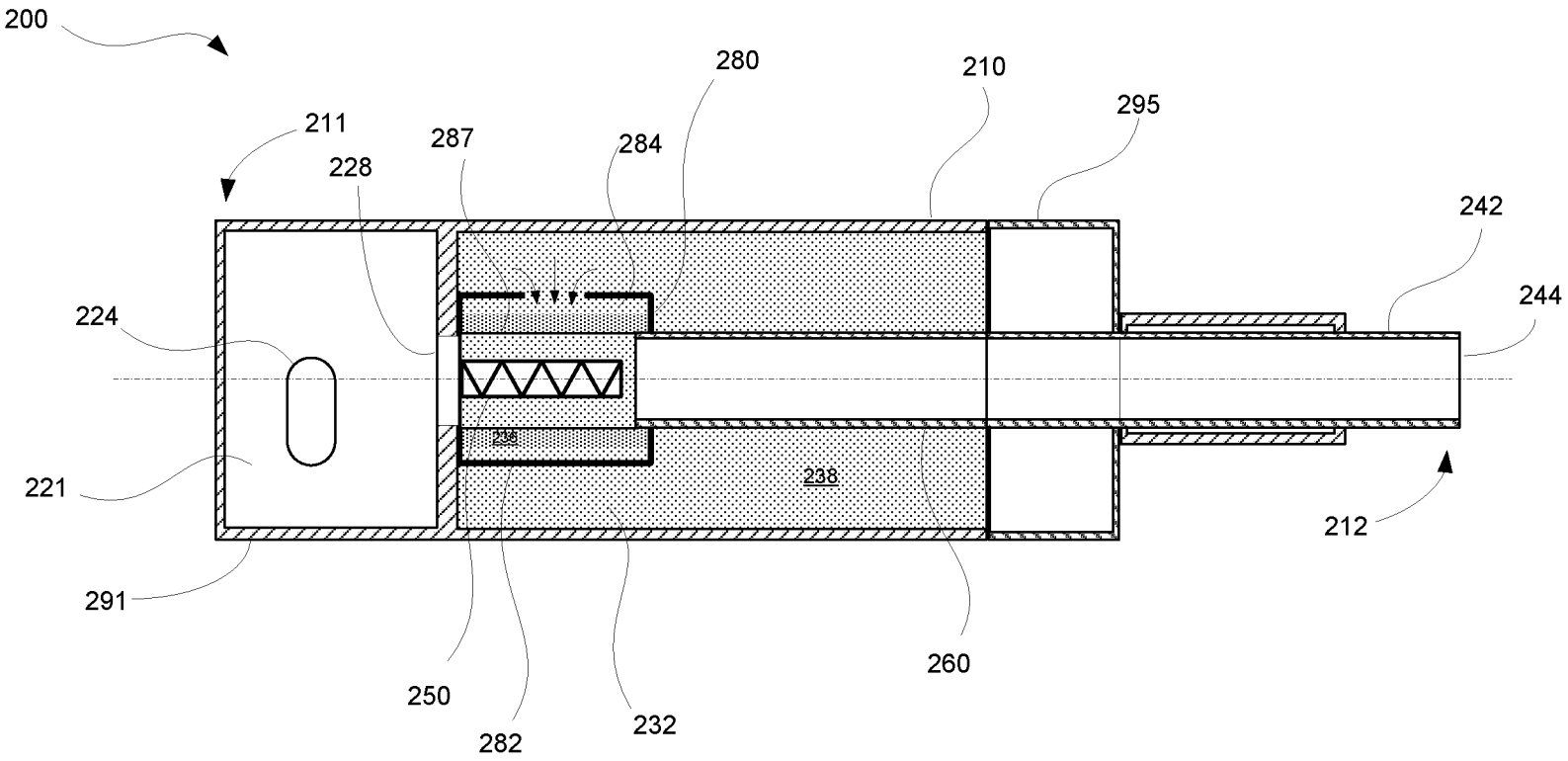
Figure 4C:
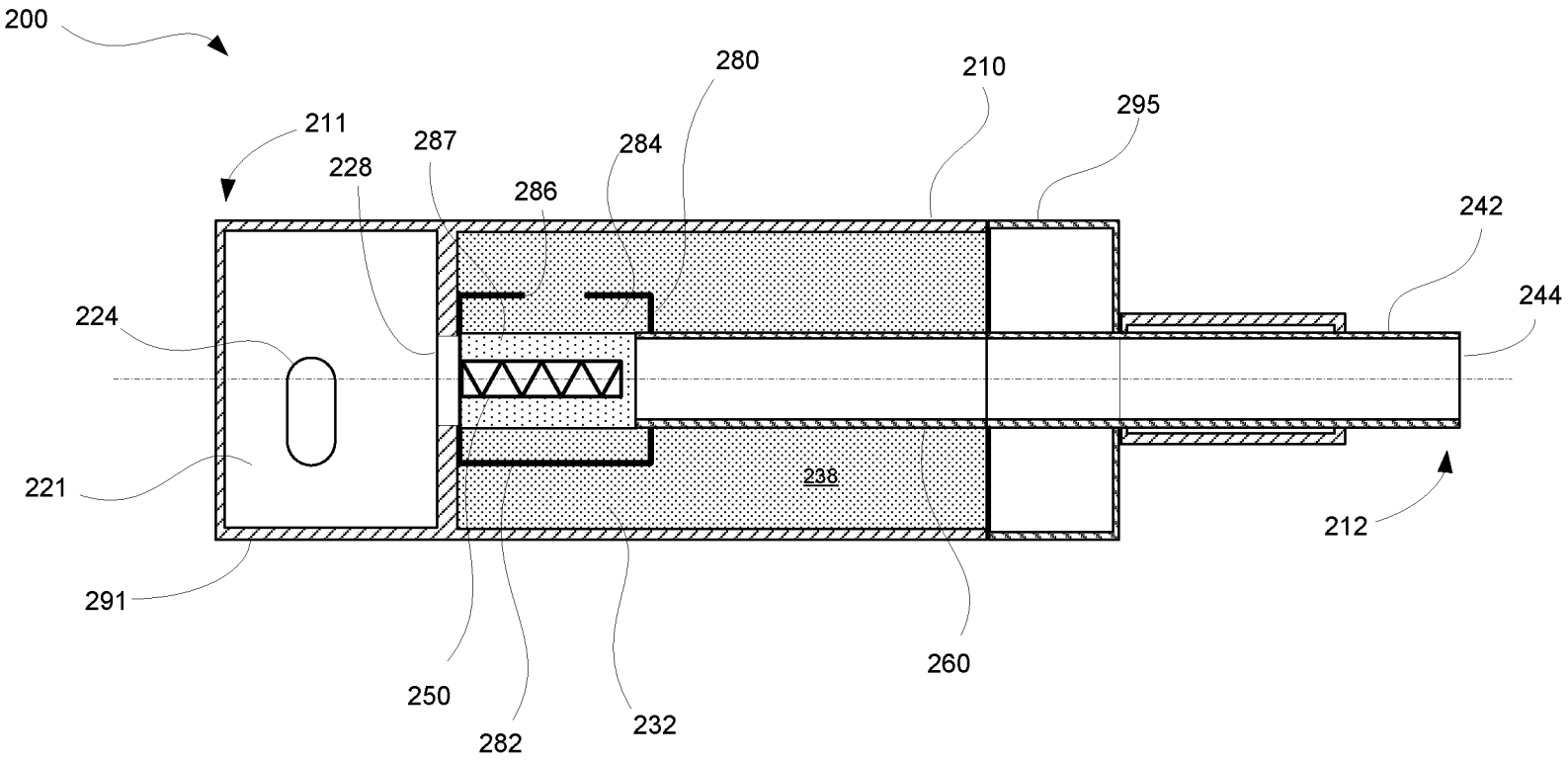

FIGS. 4A, 4B, and 4C provide schematic depictions of a personal vaporizer 200 according to another illustrative aspect of the invention. The personal vaporizer 200 has a configuration that is generally similar to the vaporizer of FIGS. 2 and 3. It comprises a cylindrical body 210 having an air inlet section 220 defining a distal end 211, a reservoir/vaporization section 230, and a cap 295. A mouthpiece section 240 extends proximally from the cylindrical body 210. The mouthpiece section 240 comprises a mouthpiece 242 defining a proximal end 212 and an exit port 244.

The reservoir/vaporization section 230 includes a fluid reservoir 232 in which is disposed a main or primary vaporizable fluid 238. The fluid reservoir 232 may be configured as a simple tank in which the fluid 238 is disposed. In some embodiments, the reservoir 230 may comprise an adsorptive or absorptive material or structure that retains the vaporizable fluid 238. A fluid transport structure 280 is configured and positioned to be in contact with the fluid 238 in the reservoir 232 and for drawing the fluid 238 out of the reservoir 232. In the illustrated embodiment, the fluid transport structure 280 comprises a tubular wick structure 284 surrounded by a cylindrical case 282. An opening 286 in the case 282 allows fluid communication between the wick structure 284 and the fluid 238 in the reservoir 232. The tubular wick structure 284 defines a vaporization chamber 287 in which a heating coil 250 is positioned. The wick structure 284 is configured to draw fluid 238 from the reservoir 232 into close proximity or in contact with the heating element 250. The heating element 250 may be configured to heat the vaporizable fluid through any conductive, convective, and/or radiative heat transfer mechanism. A chimney 260 extends between the vaporization chamber 287 and the mouthpiece 242 and defines a passageway for air and vaporization products to flow from the vaporization chamber 287 to the exit port 244.

The air inlet section 220 has a case wall 291 defining an inlet chamber 221. One or more air inlet ports 224 are formed through the case wall 291 to allow air to pass from the atmosphere into the inlet chamber 221. An inlet passageway 228 provides fluid communication between the inlet chamber 221 and the vaporization chamber 287. As in the previous embodiment, the personal vaporizer 200 also includes a power source (e.g., a battery) in communication with the heating coil 250 and a mechanism for selectively activating the heating coil.

The personal vaporizer 200 differs from conventional devices in that the wick structure 284 is "pre-charged" with a precursor vaporizable fluid 236 that may have characteristics that are the same or different from those of the primary vaporizable fluid 238. Thus, when the vaporizer 200 is first used, the initial vaporization products will be provided solely by the precursor fluid 236 as shown in FIG. 4A. As the precursor fluid 236 is transported to the inner surface of the wick structure 284, the wick structure 284 begins to draw the primary vaporizable fluid 238 from the reservoir 232 as shown in FIG. 4B. When the precursor fluid 236 is exhausted, the vaporization products are provided only by the second vaporizable fluid 238 as shown in FIG. 4C.

In particular variations of the personal vaporizer 200, the characteristics of the precursor fluid 236 and the primary fluid 238 may be selected to provide particular characteristic variations. In one example, the precursor fluid 236 could have a lower concentration of an active ingredient (e.g., a flavorant) also found in the primary fluid 238.

Figure 5A:
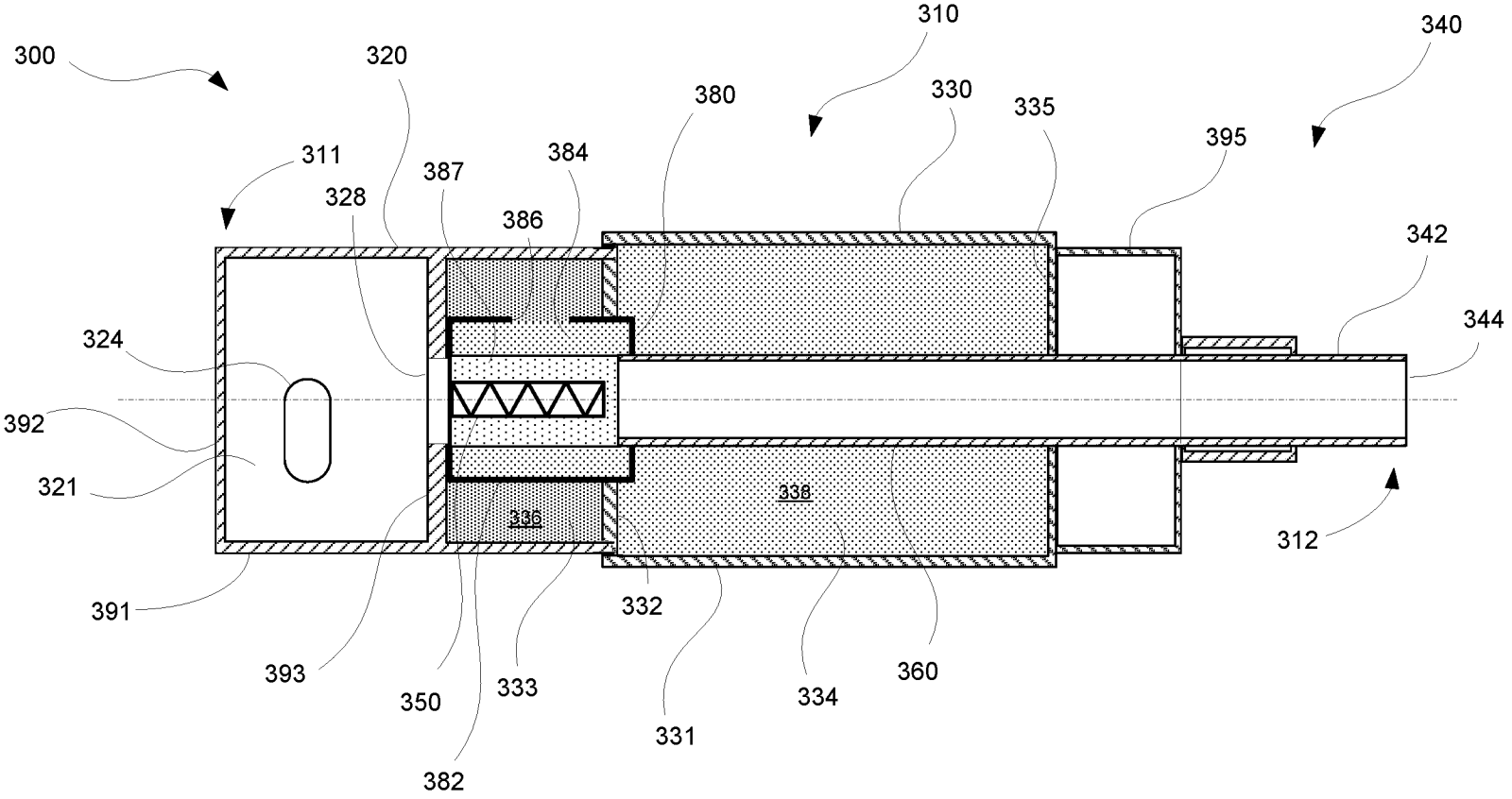
FIGS. 5A, 5B, and 5C are full sectioned views of a personal vaporizer according to an embodiment of the invention.
Figure 5B:
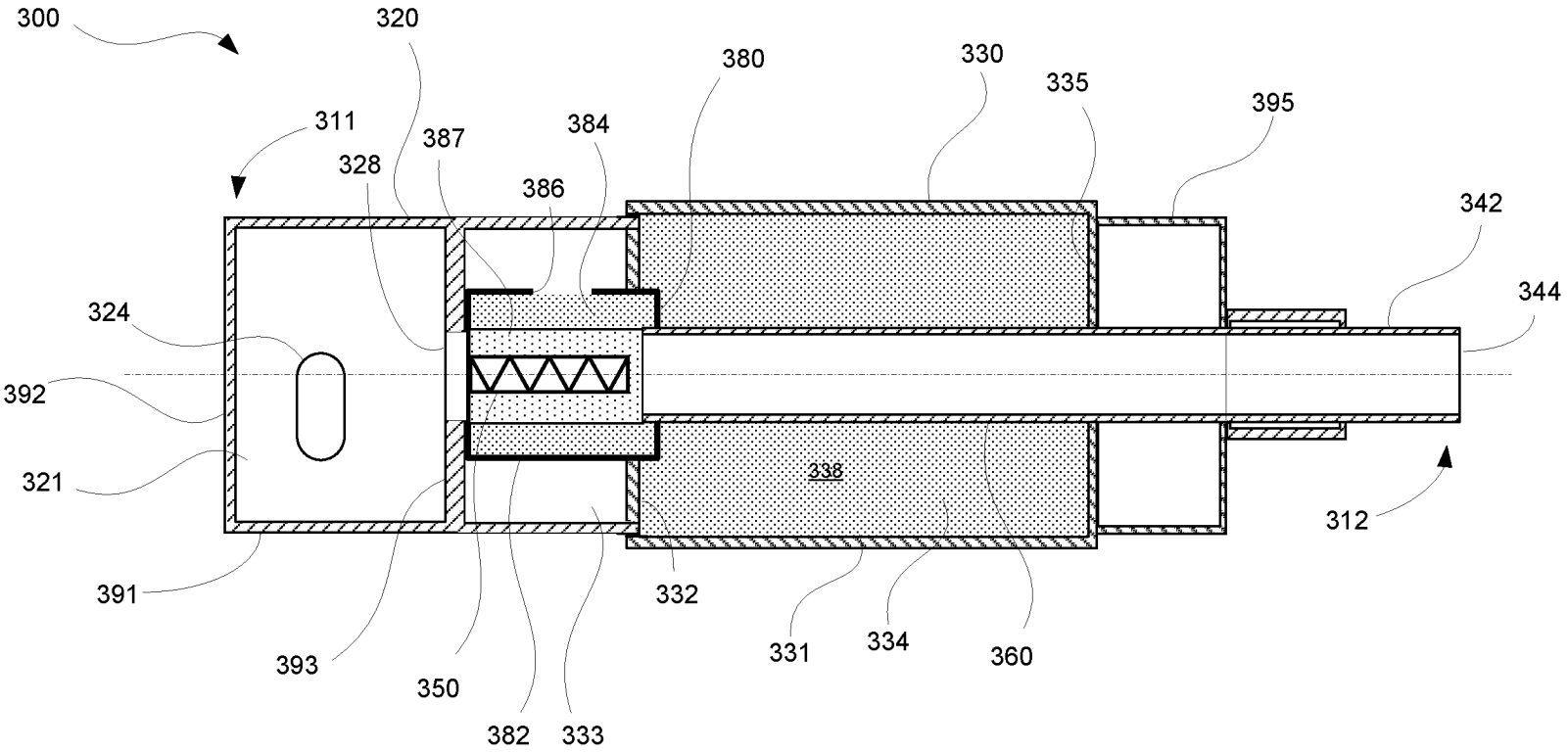
Figure 5C:
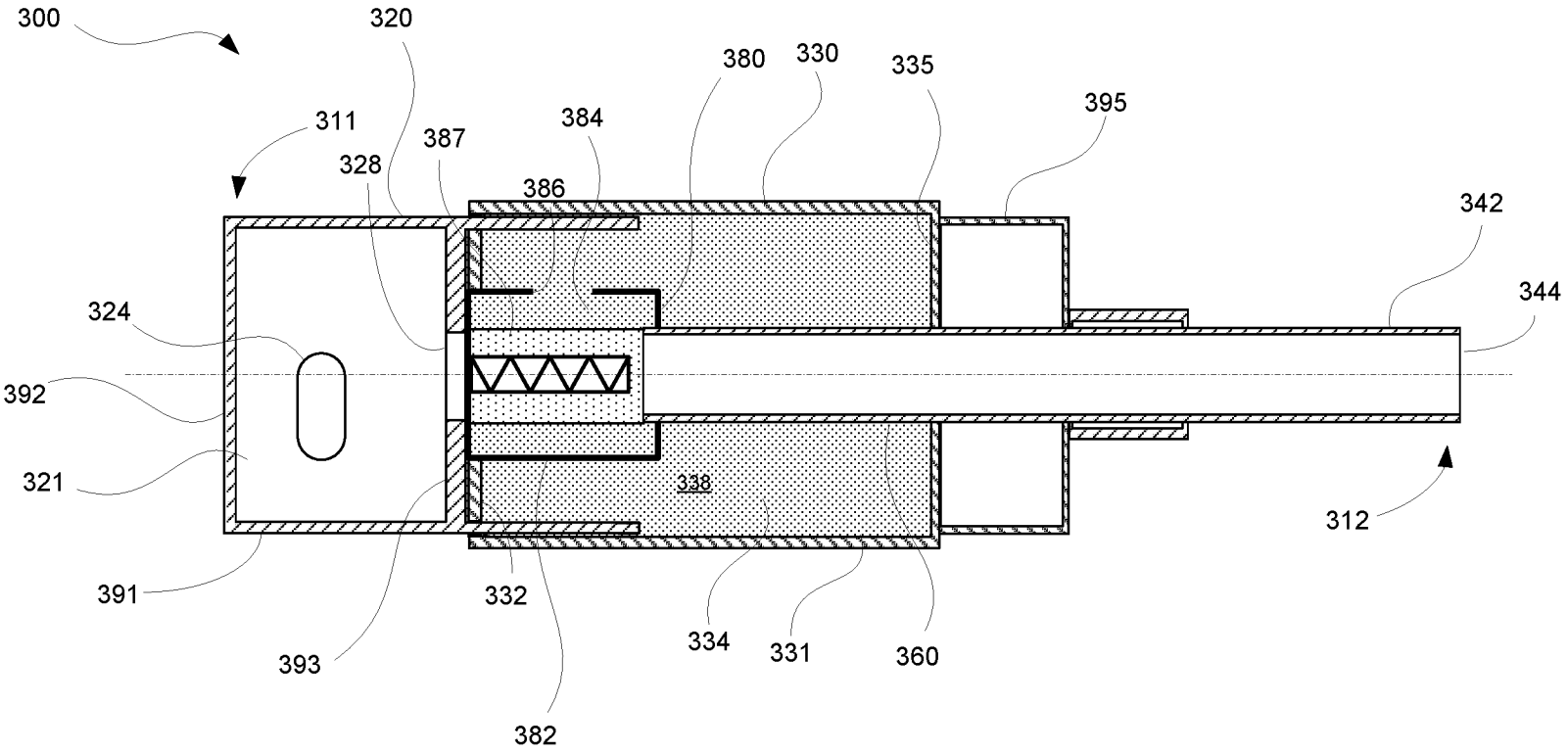

FIGS. 5A, 5B, and 5C provide schematic depictions of a personal vaporizer 300 according to an illustrative aspect of the invention. The personal vaporizer 300 comprises a two-part cylindrical main body 310 having a distal case section 320 defining a distal end 311 and a proximal case section 330 having a cap 395. A mouthpiece section 340 extends proximally from the reservoir section 330. The mouthpiece section 340 comprises a mouthpiece 342 defining a proximal end 312 and an exit port 344.

The distal case section 320 has a cylindrical distal case wall 391 and a distal base wall 392. The interior of the distal case section 320 is divided by air inlet partition wall 393 into an inlet chamber 321 and a precursor reservoir 333. One or more air inlet ports 324 are formed through the case wall 391 to allow air to pass from the atmosphere into the inlet chamber 321. The proximal case section 330 has a cylindrical case wall 331 and a reservoir base wall 332 that collectively define a primary fluid reservoir 334 closed off on its proximal side by a proximal reservoir wall 335, which may be defined by a cap 395. The proximal case section 330 and the distal case section 320 are collectively configured so that the cylindrical distal case wall 391 is partially slidably (i.e., telescopically) received into the primary fluid reservoir 334 and so that the reservoir base wall 332 is partially slidably received into the precursor reservoir 333. The proximal case section 330 and the distal case section 320 are further configured so that when the precursor reservoir 333 is substantially empty, the distal case section 320 can be selectively moved in a proximal direction relative to the proximal case section 330 so that the distal case wall 391 is received further into the primary reservoir 334. As a result of this movement, the personal vaporizer 300 can be transitioned from the initial (precursor fluid flow) configuration shown in FIGS. 5A and 5B to the primary fluid flow configuration shown in FIG. 5C in which the reservoir base wall 332 is adjacent or in contact with the air inlet partition wall 393.

It will be understood that the proximal and distal case sections 330, 320 could alternatively be configured so that the distal case section 320 has a larger diameter than the proximal case section and so that the cylindrical case wall 331 and the reservoir base wall are telescopically receivable within the distal case wall 391.

While not shown in the drawings, the personal vaporizer 300 may include locking mechanisms that retain the case sections 320, 330 in either the in the precursor fluid flow configuration or the primary fluid flow configuration unless or until released by a user.

The personal vaporizer 300 further includes a fluid transport structure 380 at least partially disposed within the precursor reservoir 333. The fluid transport structure 380 is configured and positioned to be in contact with fluid disposed within the precursor reservoir 333 and for drawing that fluid out of the precursor reservoir 333. In the illustrated embodiment, the fluid transport structure 380 comprises a tubular wick structure 384 surrounded by a cylindrical case 382. An opening 386 in the case 382 allows fluid communication between the wick structure 384 and the fluid in the precursor reservoir 333. The tubular wick structure 384 defines a vaporization chamber 387 in which a heating coil 350 is positioned. An inlet passageway 328 through the air inlet partition wall 393 provides fluid communication between the inlet chamber 321 and the vaporization chamber 387. The wick structure 384 is configured to draw fluid from the precursor reservoir 333 into close proximity or in contact with the heating element 350. The heating element 350 may be configured to heat the vaporizable fluid through any conductive, convective, and/or radiative heat transfer mechanism. In typical vaporizers, the heating element 350 is or includes a resistance element in the form of a wire coil. In some cases, the resistance element is housed within a heat conductive casing. A chimney 360 extends between the vaporization chamber 387 and the mouthpiece 342 and defines a passageway for air and vaporization products to flow from the vaporization chamber 387 to the exit port 344.

While not shown in the drawings, the personal vaporizer 300 also includes a power source (e.g., a battery) in communication with the heating coil 350 and a mechanism for selectively activating the heating coil.

The personal vaporizer 300 is configured so that when it is in the precursor fluid flow configuration, both the precursor reservoir 333 and the primary reservoir 338 may be filled with vaporizable fluid. The precursor reservoir 333 may be configured as a simple tank/fillable volume. The primary fluid reservoir 334 may also be configured as a simple tank or may comprise an adsorptive or absorptive material or structure configured for retaining and/or transporting a liquid. As shown in FIG. 5A, the precursor reservoir 333 may be filled with a first vaporizable fluid 336, and the primary reservoir 334 may be filled with a second vaporizable fluid 338. It will be understood that the reservoir base wall 332 serves to completely separate the two fluids 336, 338.

When the personal vaporizer 300 is in the precursor configuration of FIG. 5A, activation by a user will result in the first vaporizable fluid 336 being drawn into and through the wick material 384 and into the vaporization chamber 387. In this configuration, the vaporizer 300 will produce a combined flow of air and vaporization products solely produced from the first vaporizable fluid 336. The user's experience will accordingly be based on the characteristics of the first vaporizable fluid 336 alone. Once the first vaporizable fluid 336 is exhausted, the precursor reservoir 333 will be empty as shown in FIG. 5B. With the precursor reservoir 333 empty, the user can then change the device to the primary fluid flow configuration by translating the proximal case section 330 distally relative to the distal case section 320. This positions the opening 386 in the case wall of the transport structure 380 within the primary reservoir 334 so that the second vaporizable fluid 338 is presented to the wick structure 384 as shown in FIG. 5C. When the personal vaporizer 300 is in this configuration, activation by a user will result in the second vaporizable fluid 338 being drawn into and through the wick material 384 and into the vaporization chamber 387. The resulting flow of air and vaporization products are solely produced from the second vaporizable fluid 338 and the user's experience will accordingly be based on the characteristics of the second vaporizable fluid 338 alone.

As with other embodiments of the invention, the characteristics of the first and second vaporizable fluids 336, 338 may be selected to provide particular characteristic variations, including variation in active ingredients or variations in the concentration or potency of a common active ingredient.

The multiple liquid methods and devices of the invention may be used in virtually any personal vaporizer, including those described in U.S. application Ser. No. 15/639,139, filed Jun. 30, 2017 and U.S. Prov. App. No. 62/580,490, filed Nov. 2, 2017, the complete disclosures of which are incorporated herein by reference in their entirety.

While the foregoing illustrates and describes exemplary embodiments of this invention, it is to be understood that the invention is not limited to the construction disclosed herein. The invention can be embodied in other specific forms without departing from the spirit or essential attributes. In particular, while the exemplary embodiments described above all employ two vaporizable fluids, the present invention is not limited to such embodiments and specifically encompasses other embodiments that provide for delivery of three or more vaporizable fluids.

What is claimed is:

1. A micro-vaporizer comprising:

an annular main body defining a main body interior;

a vaporization chamber within the main body interior;

a liquid delivery arrangement configured for sequential delivery of a plurality of vaporizable liquids to the vaporization chamber, the liquid delivery arrangement comprising an annular wick having an internal wick surface defining at least a portion of the vaporization chamber, a wick casing having a circumferential casing wall surrounding the annular wick, the casing wall having a liquid flow opening formed therethrough, and a liquid reservoir surrounding the wick casing and configured for storage of at least one vaporizable liquid therein, the liquid reservoir being in fluid communication with the wick via the liquid flow opening in the casing wall;

a heating element disposed within the vaporization chamber, the heating element having a heating surface adjacent or in contact with at least a portion of the internal wick surface for heating and vaporizing vaporizable liquid at or near the internal wick surface;

an air flow passage from one or more air intake openings in the case wall to the vaporization chamber, the air flow passage providing a path for air from an external ambient environment to flow into the vaporization chamber for mixing with vaporized liquid to form a vaporization mixture; and a vaporization mixture flow passage extending from the vaporization chamber to an exit port, wherein the annular main body has a first body portion having a first cylindrical case wall and a second body portion having a second cylindrical case wall, the first and second body portions being configured so that one of the first and second body portions is telescopically receivable into the other, wherein the liquid reservoir has a first reservoir chamber defined by the first cylindrical case wall, a proximal reservoir wall, and a partition wall, the first reservoir chamber being configured for receiving a first vaporizable liquid, wherein the liquid reservoir has a second reservoir chamber defined by the second cylindrical case wall, a distal reservoir wall, and the partition wall, the second reservoir chamber being configured for receiving a second vaporizable liquid, and wherein the main body is movable between an extended configuration in which the second body portion extends away from the first body portion, the partition wall is spaced apart from the distal reservoir wall, and the second reservoir chamber is in fluid communication with the annular wick via the liquid flow opening and a retracted configuration in which one of the first and second body portions is received into the other, the partition wall is adjacent the distal reservoir wall, and the first reservoir chamber is in fluid communication with the annular wick via the liquid flow opening.

2. A micro-vaporizer according to claim 1, wherein at least one of the plurality of vaporizable liquids comprises at least one active material.

3. A micro-vaporizer according to claim 2, wherein the at least one active material includes at least one flavorant.

4. A micro-vaporizer according to claim 2, wherein the at least one active material includes one of the set consisting of marijuana, hemp, cannabidiol (cbd), citronella, geraniol, mint, thyme, tobacco, *Salvia dorrii, Salvia, Passiflora incarnata, Arctostaphylos uva-ursi, Lobelia inflata*, lemon grass, cedar wood, clove, cinnamon, coumarin, helio, vanilla, menthol, *Eucalyptus*, peppermint, rosemary, lavender, licorice, and cocoa.

5. A micro-vaporizer according to claim 1, wherein the plurality of vaporizable liquids includes a first vaporizable liquid comprising a first active material at a first concentration and a second vaporizable liquid comprising a second active material at a second concentration.

6. A micro-vaporizer according to claim 5, wherein the first active material is the same as the second active material but the first concentration is different from the second concentration.

7. A micro-vaporizer according to claim 1, wherein the main body can only be moved into the retracted configuration when there is no liquid in the second reservoir chamber.

* * * * *